US007866584B2

(12) United States Patent
Guerrero Palma et al.

(10) Patent No.: US 7,866,584 B2
(45) Date of Patent: Jan. 11, 2011

(54) VERTICAL MILL

(75) Inventors: Pedro Guerrero Palma, Lippetal (DE); Karl Menzel, Ennigerloh (DE)

(73) Assignee: Polysius AG, Beckum (DE)

( * ) Notice: Subject to any disclaimer, the term of this patent is extended or adjusted under 35 U.S.C. 154(b) by 554 days.

(21) Appl. No.: 11/817,747

(22) PCT Filed: Feb. 28, 2006

(86) PCT No.: PCT/EP2006/001842

§ 371 (c)(1),
(2), (4) Date: May 6, 2008

(87) PCT Pub. No.: WO2006/092277

PCT Pub. Date: Sep. 8, 2006

(65) Prior Publication Data

US 2009/0039187 A1 Feb. 12, 2009

(30) Foreign Application Priority Data

Mar. 3, 2005 (DE) ..... 10 2005 010 069

(51) Int. Cl.
*B02C 15/00* (2006.01)

(52) U.S. Cl. ..... 241/117

(58) Field of Classification Search ..... 241/117–121, 241/275

See application file for complete search history.

(56) References Cited

U.S. PATENT DOCUMENTS

| | | | | |
|---|---|---|---|---|
| 984,584 | A | | 2/1911 | McCone et al. |
| 5,524,840 | A | * | 6/1996 | Gygi ..... 241/117 |
| 6,138,933 | A | | 10/2000 | Chevalier et al. |

FOREIGN PATENT DOCUMENTS

| | | |
|---|---|---|
| DE | 957 435 | 8/1956 |
| DE | 195 03 179 | 8/1996 |

* cited by examiner

*Primary Examiner*—Faye Francis
(74) *Attorney, Agent, or Firm*—Gifford, Krass, Sprinkle, Anderson & Citkowski, P.C.

(57) ABSTRACT

The invention relates to a vertical mill comprising a grinding track (1) and at least one grinding roller (2). The grinding track (1) is provided with a central zone (Ia) made of a harder material and two laterally adjacent edge zones (Ib, Ic) made of a softer material. The width (a) of the central zone (Ia) is smaller than or equal to the width of the grinding roller (2).

10 Claims, 4 Drawing Sheets

VERTICAL MILL

The invention relates to a vertical mill with a grinding track and at least one grinding roller.

A wide variety of embodiments of vertical mills are known from the prior art. These mills usually comprise a rotatably disposed grinding ring on the top side of which an annular grinding track is formed. In most cases a plurality of grinding rollers are distributed over the circumference of this grinding track and come into rolling contact with the grinding track during crushing.

A roller mill of this kind is known, for example, from DE-A-195 03 179. A vertical mill in which the grinding roller and the grinding track are of the same width is described in U.S. Pat. No. 984,584.

During the grinding process the grinding tools and, in particular, the grinding track are subject to increasing wear, which has an adverse effect on the throughput and the specific energy requirement of the vertical mills. This can be explained by the unwanted significant grinding bed thickness which occurs as a result of an unfavourable wear contour of the grinding track. As is particularly evident from FIG. 4, the grinding track 1 wears to a greater extent in the centre than at the edge zones. Disturbing "ridges" occur at the grinding track and prevent the grinding roller 2 from pressing the grinding bed in to a greater extent.

The object of the present invention is to improve the vertical mill such that a substantially constant grinding bed thickness can be obtained during the entire running time.

This object is solved according to the invention by the features of Claim 1.

Further configurations of the invention constitute the subject matter of the subclaims.

The vertical mill according to the invention essentially comprises a grinding track and at least one grinding roller, the grinding track comprising a central zone of a harder material and two laterally adjacent edge zones of a softer material, with the width of the central zone being smaller than or equal to the width of the grinding roller.

Figure 4:
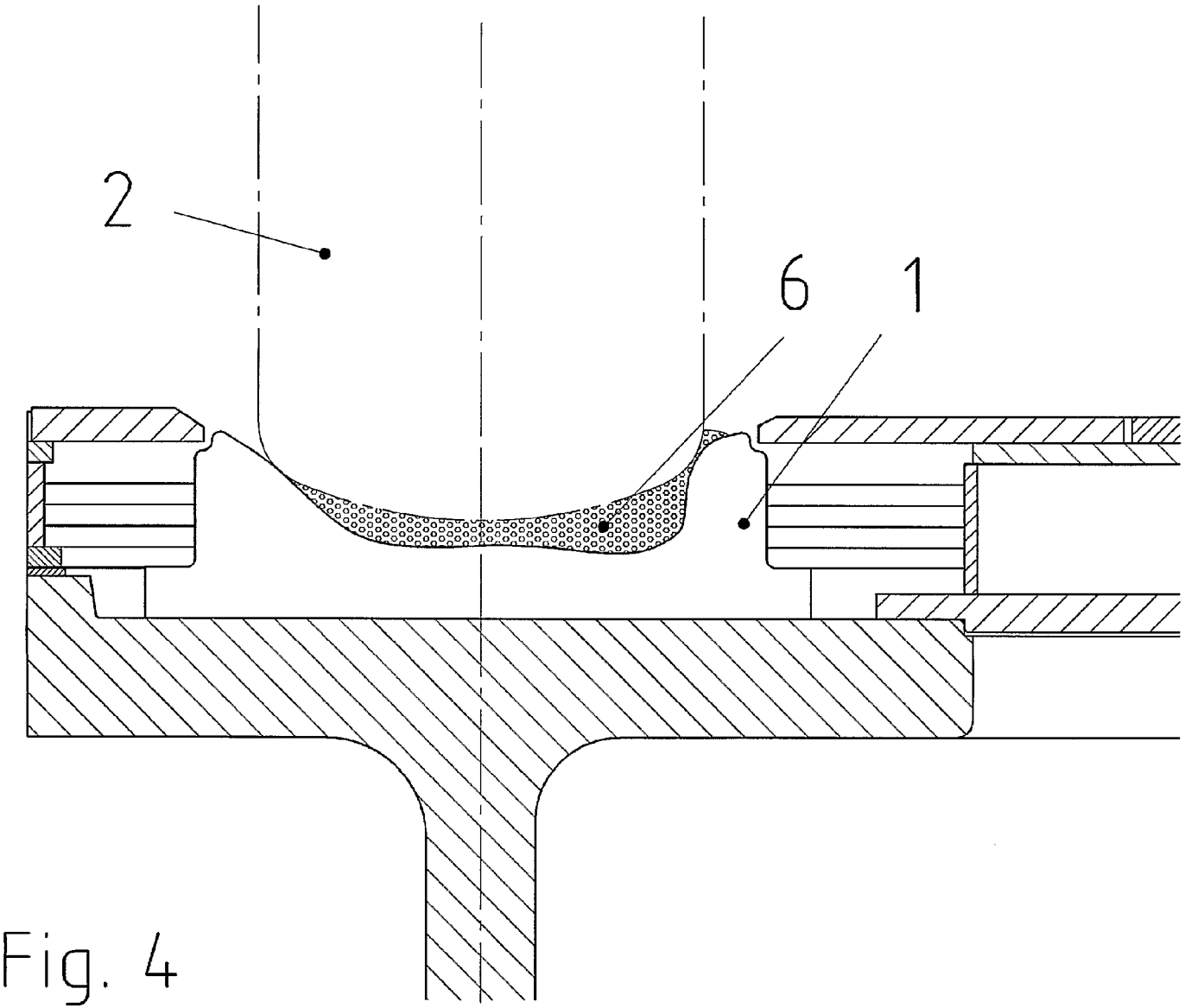

A configuration of this kind enables the formation of disturbing ridges according to FIG. 4 to be reliably prevented, so that a substantially constant material bed thickness is obtained over the entire running time. A narrower grinding track is therefore possible with the same grinding roller, whereby the weight and the costs of the grinding track can be reduced. It has, moreover, become apparent, in the tests underlying the invention, that the grinding track enables a longer working life to be achieved, in spite of the lower weight.

The grinding rollers may in particular be crowned, cylindrical and conical. According to one preferred configuration of the invention, the width of the grinding track or the width of the central zone is smaller than the width of the grinding roller. The width of the grinding track or the width of the central zone is preferably between 75% and 95% of the width of the grinding roller.

In a further configuration of the invention the grinding track is disposed on the surface of a grinding ring, the grinding track being delimited on both sides by fittings, and seals being provided between the grinding ring and the fittings.

The grinding material consists in particular of binding agents (granulated blast furnace slag, cement clinker) and raw materials for cement production (limestone). In this case the grinding roller presses with a pressure of 600 to 1800 kN/m$^2$ (force on projected roller face).

Further advantages and configurations of the invention are illustrated in detail on the basis of the description of several examples and the drawings.

In the drawings

Figure 1:
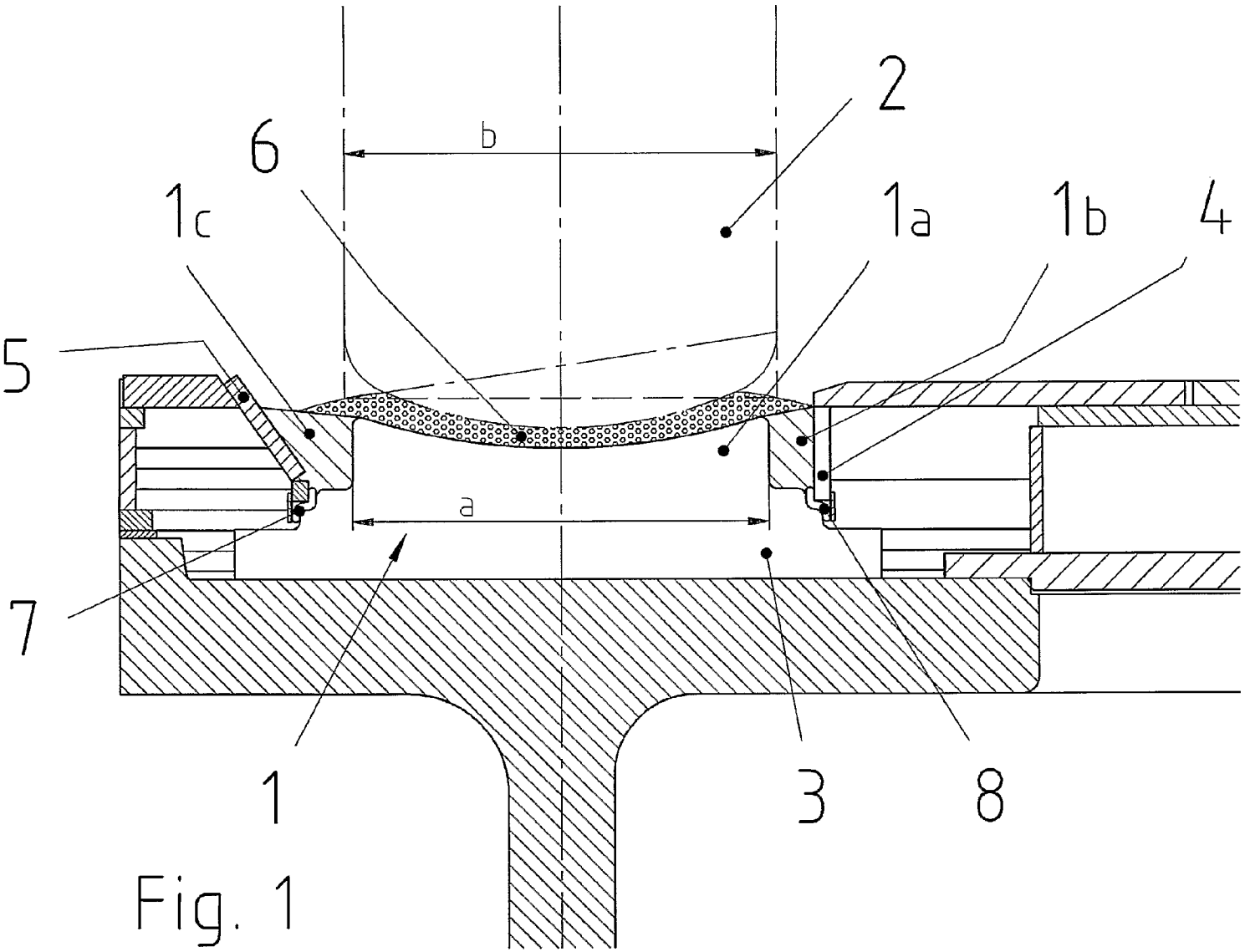
Figure 2:
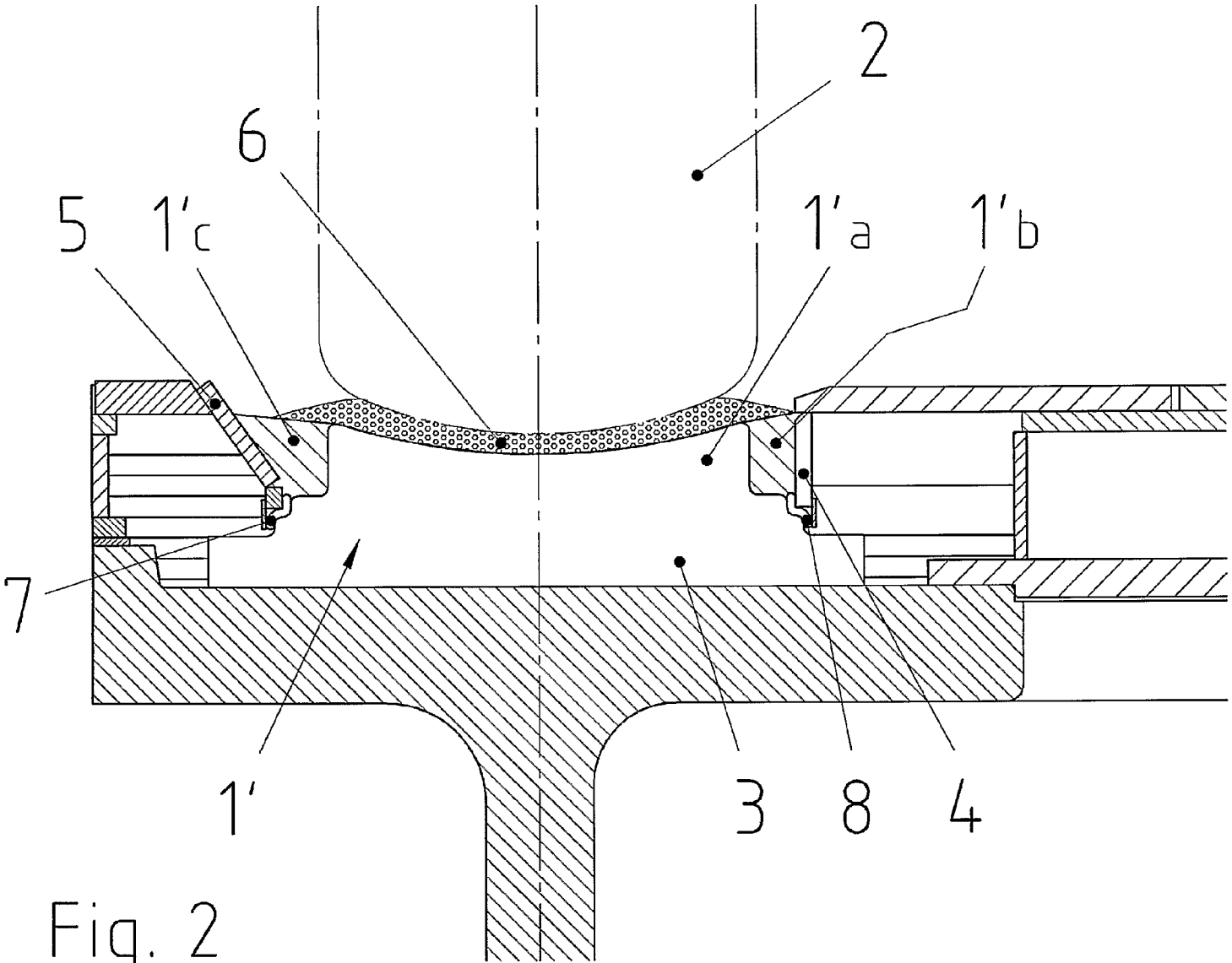
Figure 3:
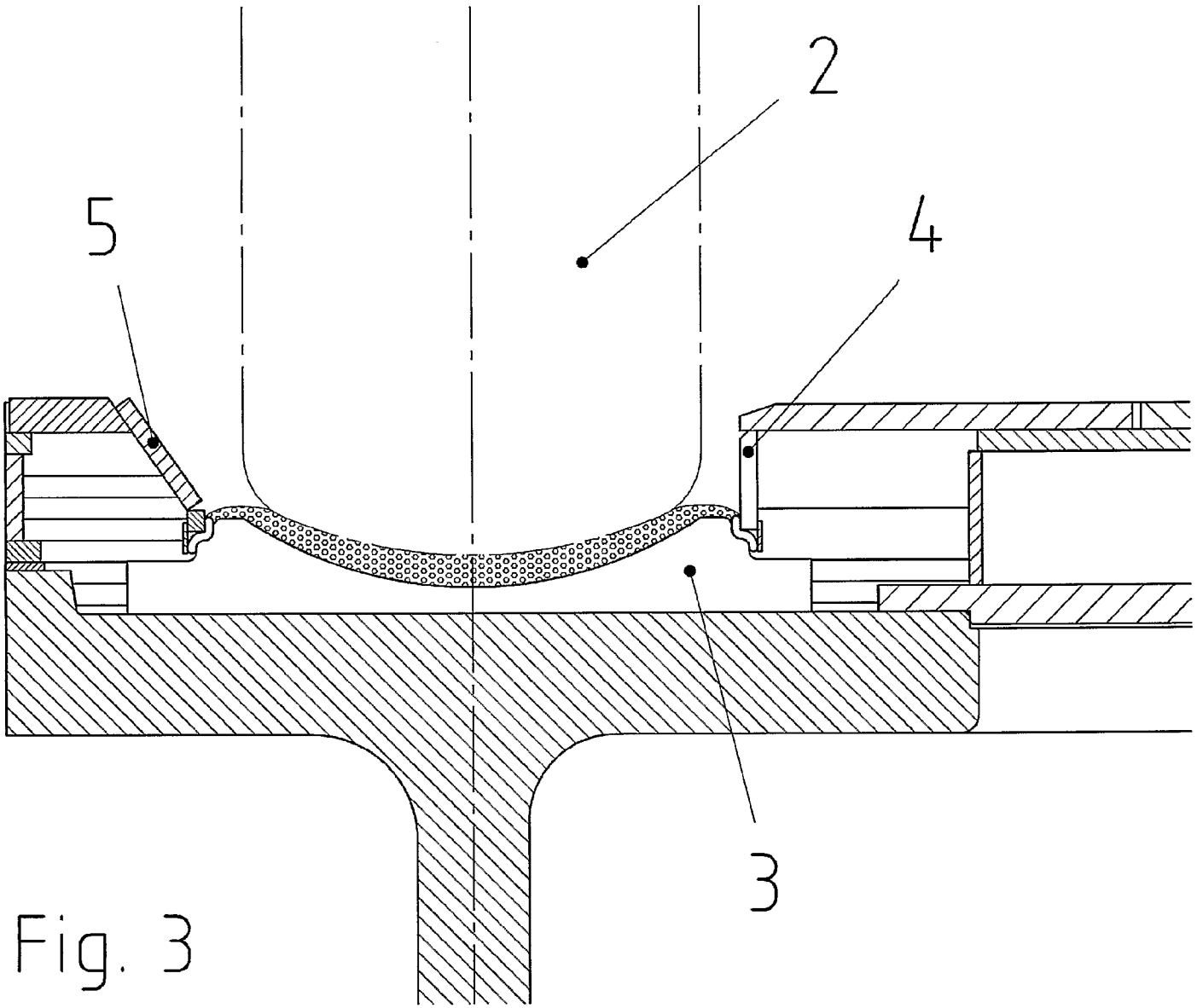

FIG. 1 is a sectional representation of a vertical mill in the region of the grinding track and the grinding roller according to a first embodiment, FIG. 2 is a sectional representation of a vertical mill in the region of the grinding track and the grinding roller according to a second embodiment, FIG. 3 is a sectional representation of the vertical mill according to FIG. 1 or FIG. 2 after the grinding track has worn and FIG. 4 is a schematic sectional representation of a vertical mill in the region of the grinding track and the grinding roller according to the prior art.

The vertical mill which is represented in a detail view in FIG. 1 consists essentially of a grinding ring 3 which rotates about a vertical axis of rotation and to the surface of which a grinding track 1 is fastened. One or a plurality of grinding roller(s) 2 roll(s) on this grinding track, with the grinding material 6 being crushed between the grinding track and the grinding roller.

Fittings 4, 5 are provided on both sides of the grinding track 1, these being disposed at a radial distance from the grinding track. These fittings serve to delimit the grinding material layer. The grinding track 1 comprises a central zone 1*a* of a harder material and two laterally adjacent edge zones 1*b*, 1*c* of a softer material. Here the width a of the central zone 1*a* is smaller than or equal to the width b of the grinding roller 2. As the edges zones 1*b*, 1*c* are made of a softer material, no disturbing ridges form here. This configuration enables the grinding roller 2 to penetrate deeply and unchecked into the grinding bed during the entire operating time of the grinding track. Either no ridges at all occur at the edge of the central zone 1*a* or such ridges are removed by the grinding roller. The wear pattern which is represented in FIG. 3 is obtained at the end of the operating time.

Seals 7, 8 are provided between the fittings 4 and 5, respectively, and the grinding ring 3 in order to guarantee sufficient sealing between the grinding track and the laterally adjacent zones at the end of the operating time.

In the case of the grinding track 1' which is represented in FIG. 2 the laterally adjacent edge zones 1'*b*, 1'*c* are formed by grinding material, and the two edge zones 1'*b*, 1'*c* which are formed by grinding material are in the first place delimited by the central zone 1'*a* and the fittings 4,5.

In the represented embodiments the grinding rollers 2 are in each case of crowned formation. However, as indicated by broken lines in FIG. 1, the grinding roller may also be of cylindrical or conical (dash-dot line) formation.

According to one preferred configuration, the width a of the central zone 1*a*, 1'*a* is smaller than the width b of the grinding roller, the width a preferably being between 75% and 95% of the width b of the grinding roller.

The vertical mills described above are distinguished by a grinding track which is narrower when compared with the prior art and which has the advantage of a constant grinding bed thickness being obtained over the entire running time. A longer working life is also obtained with this design, in spite of the lower wearing weight.

The invention claimed is:

1. Vertical mill with a grinding track (1) and at least one grinding roller (2), characterised in that the grinding track (1; 1') comprises a central zone (1*a*; 1'*a*) of a harder material and two laterally adjacent edge zones (1*b*, 1*c*; 1'*b*, 1'*c*) of a softer material, wherein the width (a) of the central zone (1*a*; 1'*a*) is smaller than or equal to the width (b) of the grinding roller (2).

2. Vertical mill according to claim 1, characterised in that the laterally adjacent edge zones (1'*b*, 1'*c*) of the grinding track are formed by grinding material.

3. Vertical mill according to claim 1, characterised in that the grinding roller (2) is of crowned formation.

4. Vertical mill according to claim 1, characterised in that the grinding roller (2) is of cylindrical formation.

5. Vertical mill according to claim 1, characterised in that the grinding roller (2) is of conical formation.

6. Vertical mill according to claim 1, characterised in that the width (a) of the grinding track (1) or of the central zone (1*a*, 1'*a*) is smaller than the width (b) of the grinding roller (2).

7. Vertical mill according to claim 1, characterised in that the width (a) of the grinding track (1) or of the central zone (1*a*, 1'*a*) is between 75% and 95% of the width of the grinding roller.

8. Vertical mill according to claim 1, characterised in that fittings (4, 5) are provided on both sides of the grinding track (1), these being disposed at a radial distance from the grinding track.

9. Vertical mill according to claim 1, characterised in that fittings (4, 5) are provided on both sides of the grinding track (1), these being disposed at a radial distance from the grinding track, wherein the interspace which forms is filled with grinding material.

10. Vertical mill according to claim 1, characterised by a grinding ring (3), on the surface of which the grinding track (1) is disposed, which track is delimited on both sides by fittings (4, 5), wherein seals (7, 8) are provided between the grinding ring and the fittings.

* * * * *